United States Patent [19]

Yui et al.

[11] Patent Number: 5,032,870

[45] Date of Patent: Jul. 16, 1991

[54] ELECTROPHOTOGRAPHIC APPARATUS

[75] Inventors: Yuhi Yui; Yukinori Andou; Kouichi Irihara; Masatsugu Nakamura, all of Nara, Japan

[73] Assignee: Sharp Kabushiki Kaisha, Osaka, Japan

[21] Appl. No.: 536,730

[22] Filed: Jun. 12, 1990

[30] Foreign Application Priority Data

Jun. 20, 1989 [JP] Japan ..... 1-158076

[51] Int. Cl.[5] ..... G03G 15/02

[52] U.S. Cl. ..... 355/219; 355/221; 355/225

[58] Field of Search ..... 355/219, 221, 223, 222, 355/225, 268

[56] References Cited

FOREIGN PATENT DOCUMENTS 56-16155 2/1981 Japan .
59-105673 6/1984 Japan .

*Primary Examiner*—R. L. Moses
*Attorney, Agent, or Firm*—Irell & Manella

[57] ABSTRACT

An electrophotographic apparatus comprising a power supply, a detection means, a voltage control means, and an exposure unit control means, whereby the provision of a special discharge unit can be omitted to allow the reduction in the size and cost of the apparatus. Also, carrier attraction and toner adherence to the photoconductor can be prevented when the photoconductor is stopped after completion of an image forming operation.

4 Claims, 4 Drawing Sheets

ELECTROPHOTOGRAPHIC APPARATUS

BACKGROUND OF THE INVENTION

1. Field of the Invention

The present invention relates to an electrophotographic apparatus such as an electrostatic image transfer copying machine, a laser printer or the like.

2. Description of the Prior Art

FIG. 4 shows a conventional electrophotographic apparatus, in which the surface of a photoconductor 31 charged at a prescribed potential by a charger 32 is exposed to a laser beam 33 emitted from an exposure unit (not shown), resulting in an electrostatic latent image on the surface of the photoconductor 31 as a result of the potential difference between the exposed areas where the potential is reduced and the unexposed areas where the original potential is retained. The electrostatic latent image is developed into a toner image by means of a developer unit 34, the toner image then being transferred by means of a transfer charger 36 onto copy paper 35 fed from a paper feed unit (not shown). Thereafter, the copy paper 35 onto which the toner image has been transferred undergoes a fixing process by a fixing unit (not shown), and is discharged to the outside of the machine. The toner remaining on the surface of the photoconductor 31 after the transfer process is scraped off the surface thereof by means of a cleaning unit 37. The residual potential on the surface of the photoconductor 31 is removed by means of a discharge lamp 38 before the next copy cycle is performed.

The removal of the residual potential on the photoconductor 31 performed by the discharge lamp 38 after the transfer process is an indispensable process. Without the discharge process, the potential on the photoconductor 31 would continue to rise through repeated charge by the charger 32, eventually causing a dielectric breakdown of the photoconductor because of excessive charges.

On the other hand, the provision of a special discharge unit such as the discharge lamp 38 would constitute a disadvantageous factor with regard to reduction in the size and cost of the machine. Therefore, previously there have been proposed techniques that do not require the provision of a special discharge unit, which include, for example, a construction as disclosed in Japanese Laid-Open Patent Publication No. 56-16155 wherein a transfer charger is utilized for discharging the photoconductor, and a construction as disclosed in Japanese Laid-Open Patent Publication No. 59-105673 wherein a laser beam emitted from an exposure unit is split to discharge the photoconductor 31.

However, while both of the above-mentioned conventional constructions have been successful in eliminating the need for a special discharge unit, neither of them have been able to avoid the problems accompanying the reversal developing method, that is, carrier attraction and toner adherence to the photoconductor 31 after completion of an image forming operation. Such phenomena cause problems in the production of a good copy image.

SUMMARY OF THE INVENTION

The electrophotographic apparatus of the present invention, which overcomes the above-discussed and numerous other disadvantages and deficiencies of the prior art, is an electrophotographic apparatus wherein an image forming operation is performed in such a way that the surface of a photoconductor is first charged at a prescribed potential by a main charger and then exposed to light projected from an exposure unit to form an electrostatic latent image thereon which is then developed into a toner image by means of a developer unit and transferred onto copy paper by means of a transfer charger, the apparatus comprising: a power supply for supplying a voltage to the main charger, the developer unit, and the transfer charger; a detection means for detecting the voltage control timing of the main charger, the developer unit, and the transfer charger, as well as the operation timing of the exposure unit; a voltage control means for controlling the power supply on the basis of the voltage control timing detected by the detection means after the completion of an image forming operation in such a way that a developing bias for the developer unit is turned off after a voltage is supplied to the main charger to charge the surface of the photoconductor at a potential that does not cause carrier attraction, which is preceded by the supply of a voltage to the transfer charger to reversely charge the surface of the photoconductor to reduce the surface potential thereof to a low level after a voltage is supplied to the main charger to set the potential of the photoconductor at a prescribed high level; and an exposure unit control means for controlling the operation of the exposure unit on the basis of the operation timing of the exposure unit detected by the detection means so that the surface potential of the photoconductor is reduced nearly to the ground potential by the light projected from the exposure unit after the developing bias is turned off.

In one embodiment, the detection means is composed of a timer and an explosure unit.

In one embodiment, the voltage control means and said exposure unit control means are composed of a power control unit and a voltage output control circuit connected to said power control unit said voltage control circuit being connected to said power supply.

In one embodiment, the timer is connected to said power control unit to which said exposure unit is connected.

Thus, the invention described herein makes possible the objectives of (1) providing an electrophotographic apparatus in which the provision of a special discharge unit can be omitted to allow the reduction in the size and cost of the apparatus; and (2) providing an electrophotographic apparatus in which carrier attraction and toner adherence to the photoconductor can be prevented when the photoconductor is stopped after completion of an image forming operation.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

The present invention provides an electrophotographic apparatus in which the power supply is controlled by a voltage control means on the basis of the voltage control timing detected by a detection means after the completion of an image forming operation. First, the photoconductor is uniformly charged at a prescribed high level potential by a main charger, after which the photoconductor is reversely charged by a transfer charger, reducing the surface potential thereof to a low level. Thereafter, the surface of the photoconductor is charged by the main charger at a potential that does not cause carrier attraction. Then, the developing bias for a developer unit is turned off. In this situation, since the surface of the photoconductor is already charged at a potential that does not cause carrier attraction, no carrier attraction or toner adherence to the photoconductor is caused when the developing bias is turned off.

After the developing bias is turned off, an exposure unit control means controls the operation of an exposure unit on the basis of the operation timing of the exposure unit detected by the detection means so that the surface potential of the photoconductor is reduced nearly to the ground potential level by light projected from the exposure unit. When the photoconductor is stopped in this situation, since the surface potential of the photoconductor has been removed, there is no deterioration of the photoconductor caused by residual potential.

Figure 1:
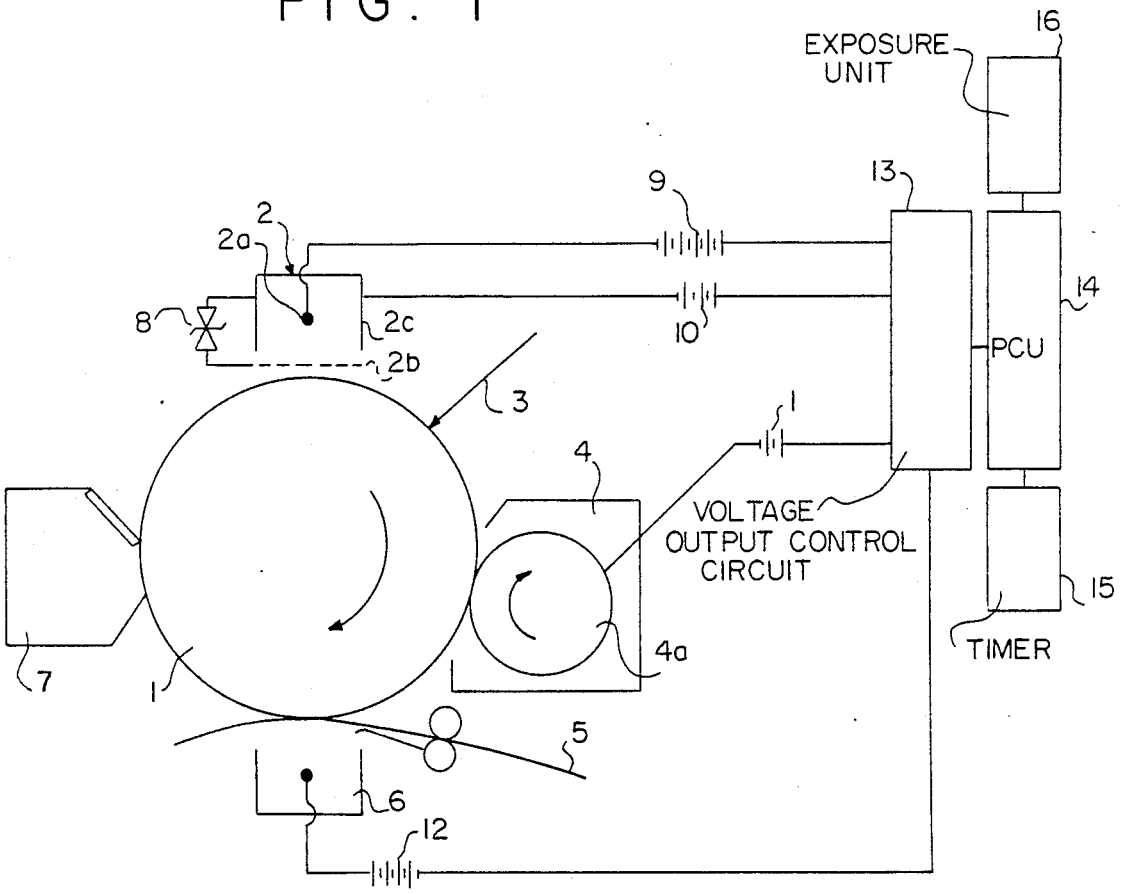
FIG. 1 is a schematic diagram showing an electrophotographic apparatus of the present invention.
Figure 2:
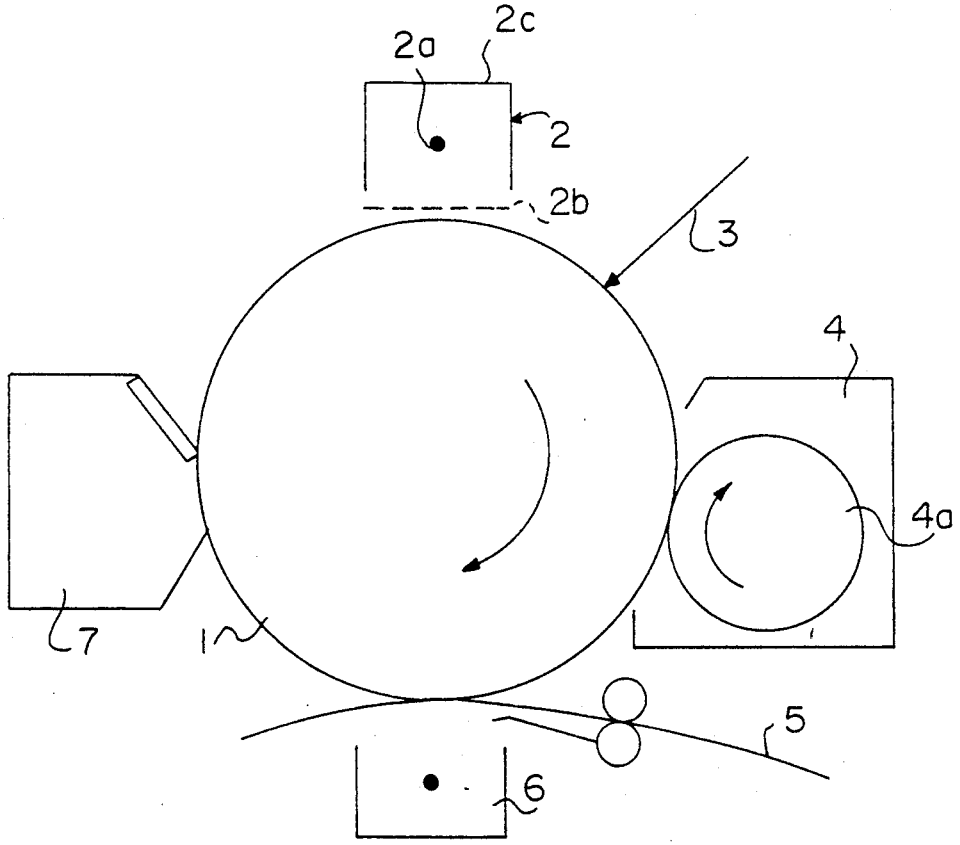
FIG. 2 is a schematic diagram showing the construction of a photoconductor and the vicinity of the photoconductor of the electrophotographic apparatus of FIG. 1.

FIGS. 1 and 2 show an electrophographic apparatus of the present invention, which comprises a photoconductor 1 around which there are disposed a scorotron charger 2 as a main charger for charging the surface of the photoconductor 1 at a prescribed potential, a developing magnetic roller 4*a* (hereinafter referred to as the MG roller), a developer unit 4 for developing an electrostatic latent image formed on the photoconductor 1 by a laser beam 3 projected from an exposure unit (not shown), a transfer charger 6 for transferring onto copy paper 5 a toner image formed on the surface of the photoconductor 1 by the developing operation of the developer unit 4, and a cleaning unit 7 for removing the toner remaining on the surface of the photoconductor 1 after completion of the transfer operation.

The scorotron charger 2 comprises an electrode 2*a* for supplying a charge to charge the photoconductor 1, a control grid 2*b* disposed between the electrode 2*a* and the photoconductor 1 for controlling the potential of the photoconductor 1, and a metal frame 2*c*. As shown in FIG. 1, the control grid 2*b* is connected to the frame 2*c* via a two-way zener diode 8 disposed therebetween. The two-way zener diode 8 serves to retain the potential difference between the control grid 2*b* and the frame 2*c* at a prescribed level when a voltage is applied therebetween at a prescribed value or more. The control grid 2*b* has the same polarity as that of the corona voltage generated by the electrode 2*a*. The voltage of the control grid 2*b* is usually set at a few hundred volts, by controlling which the necessary potential is given to the photoconductor 1.

Also, to the electrode 2*a* of the scorotron charger 2 is connected the negative terminal of a power supply 9, while the negative terminal of a power supply 10 is connected to the frame 2*c*. Moreover, the negative terminal of a power supply 11 is connected to the MG roller 4*a* of the developer unit 4, and the positive terminal of a power supply 12 to an electrode of the transfer charger 6. The positive terminals of the power supplies 9 to 11 and the negative terminal of the power supply 12 are connected to a voltage output control circuit 13 which controls the output voltages of the power supplies 9 to 12. Connected to the voltage output control circuit 13 is a power control unit 14 (hereinafter abbreviated as the PCU) to which a timer 15 as a detection means, and an exposure unit 16 are connected.

The timer 15 counts the time for controlling the power supplies 9 to 12, as well as the time for controlling the operation of the exposure unit 16. The PCU 14 controls the operation of the voltage output control circuit 13 and exposure unit 16 on the basis of the control timings counted by the timer 15. That is, the PCU 14, in combination with the voltage output control circuit 13, constitutes a voltage control means as well as an exposure unit control means. The voltage output control circuit 13 controls the output voltages of the power supplies 9 to 12 at a prescribed timing counted by the timer 15 on the basis of a control signal from the PCU 14. The exposure unit 16 projects the laser beam 3 for exposure of the photoconductor 1.

Figure 3:
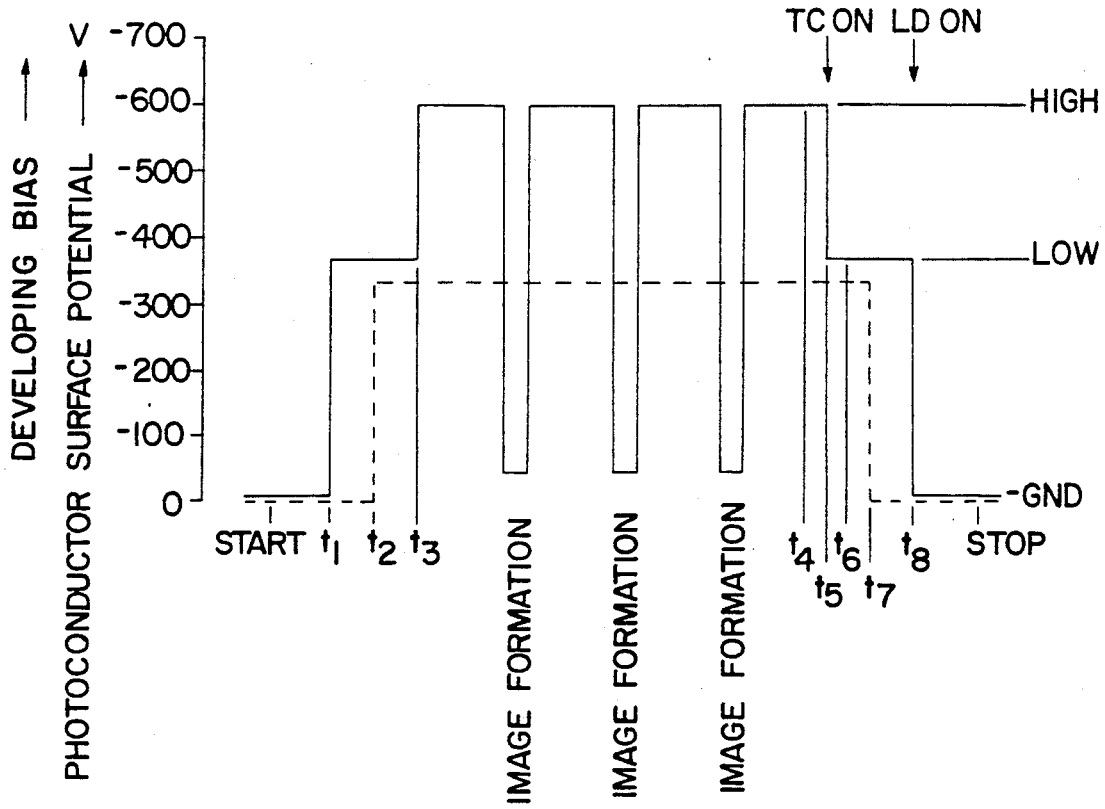
FIG. 3 is a graph showing the relationship between the potential of the surface of a photoconductor and the developing bias of an electrophotographic apparatus of the present invention.
Figure 4:
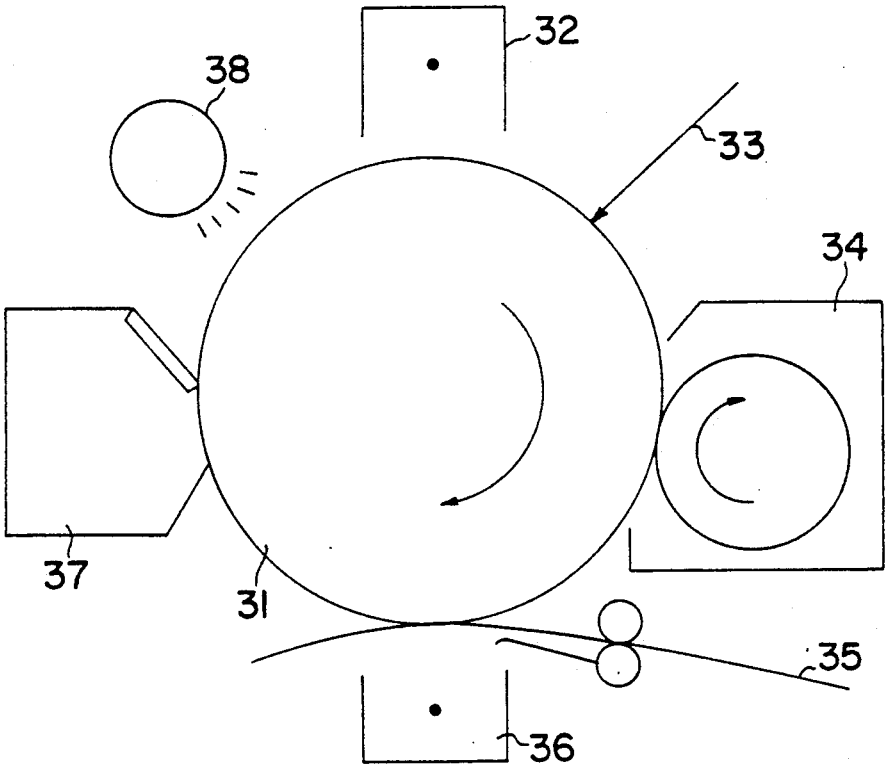
FIG. 4 is a schematic diagram showing a conventional electrophotographic apparatus.

In the above construction, to perform an image forming operation, the photoconductor 1 is first started for rotation. Next, when the time t1 is counted by the timer 15, as shown in FIG. 3, the voltage output control circuit 13 is put into operation by a command from the PCU 14 whereby the power supply 9 supplies a prescribed voltage to the electrode 2*a* of the scorotron charger 2 while the power supply 10 supplies to the frame 2*c*, and thus the control grid 2*b*, a voltage for charging the photoconductor 1 at a low level potential shown in FIG. 3, thus setting the potential of the photoconductor 1 at the low level. Thereafter, at t2, the power supply 11 applies to the MG roller 4*a* of the developer unit 4 a developing bias needed for the developing operation. Furthermore, at t3, the power supply 10 supplies to the control grid 2*b* a voltage for charging the photoconductor 1 at a high level potential, thus setting the potential of the photoconductor 1 at the high level.

In the above charging process of the photoconductor 1, when the potential of the photoconductor 1 is low, the charge supplied from the scorotron charger 2 is preferentially fed to the photoconductor 1 to charge the photoconductor 1. On the other hand, as the potential of the photoconductor 1 approaches the potential of the control grid 2*b*, the charge supplied from the scorotron charger 2 is preferentially fed to the control grid 2*b*. Thus, the potential of the photoconductor 1 is retained in a prescribed relationship with the potential of the control grid 2*b*, making it possible to control the potential of the photoconductor 1 by controlling the potential of the control grid 2*b*. The potential of the photoconductor 1 can thus be retained at a prescribed level at all times, and it is possible to continue the image forming operation in this situation.

After the surface potential of the photoconductor 1 is set at the high level, the laser beam 3 emitted from the exposure unit 16 is projected onto the surface of the rotating photoconductor 1, reducing the potential at areas subjected to the laser beam 3. As a result, an electrostatic latent image is formed on the surface of the photoconductor 1. The electrostatic latent image is then developed into a toner image with the toner distributed from the MG roller 4a of the developer unit 4. Thereafter, when the photoconductor 1 further rotates so that the toner image formed thereon reaches a position to face the transfer charger 6, the copy paper 5 is fed from the paper feed unit (not shown) in synchronism with the rotation of the photoconductor 1, so that the toner image formed on the surface of the photoconductor 1 is transferred onto the copy paper 5 by means of the transfer charger 6 to which a prescribed voltage is applied by the power supply 12. After completion of the transfer process, the toner remaining on the surface of the photoconductor 1 is scraped off by the cleaning unit 7 for collection. After moving over the cleaning unit 7, the photoconductor 1 still retains the latent image on its surface, but in the next cycle, the surface of the photoconductor 1 is uniformly recharged by the scorotron charger 2. The copy paper 5 onto which the toner image has been transferred undergoes a fixing process by a fixing unit (not shown) before being discharged to the outside of the machine.

On the other hand, after completion of the image forming operation, a voltage that sets the potential of the photoconductor 1 at the high level is first supplied, at 4, to the control grid 2b, so that the scorotron charger 2 uniformly charges the potential of the photoconductor 1 at the high level. Next, at t5, the surface of the photoconductor 1 is reversely charged by the transfer charger 6, reducing the surface potential of the photoconductor 1 to the low level. However, it is only required at this time that the potential of the photoconductor 1 be set at a level that does not cause carrier attraction, therefore, it is not particularly necessary to exert control on the output of the power supply 12 for the transfer charger 6. Thereafter, at t6, the reversely charged surface of the photoconductor 1 is further charged by the scorotron charger 2 to a potential that does not cause carrier attraction, that is, set to the low level. At this time, also, the output voltage of the power supply 10 applied to the control grid 2b is controlled as in the case previously mentioned. After that, at t7, the developing bias applied to the MG roller 4a is turned off. At this time, since the potential of the photoconductor 1 is set at the level (low level) that does not cause carrier attraction, carrier is not attracted to the photoconductor 1, nor does toner adhere thereto, when the developing bias is turned off. Then, at t8, the laser beam 3 is projected from the exposure unit 16 to decrease the surface potential of the photoconductor 1 nearly to the ground potential. After that, the rotation of the photoconductor 1 stops. At this time, since the surface potential of the photoconductor 1 is removed, there is no deterioration of the photoconductor 1 caused by the residual potential.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An electrophotographic apparatus wherein an image forming operation is performed in such a way that the surface of a photoconductor is first charged at a prescribed potential by a main charger and then exposed to light projected from an exposure unit to form an electrostatic latent image thereon which is then developed into a toner image by means of a developer unit and transferred onto copy paper by means of a transfer charger, the apparatus comprising:

a power supply for supplying a voltage to the main charger, the developer unit, and transfer charger;

a detection means for detecting the voltage control timing of the main charger, the developer unit, and the transfer charger, as well as the operation timing of the exposure unit;

a voltage control means for controlling the power supply on the basis of the voltage control timing detected by the detection means after the completion of an image forming operation in such a way that a developing bias for the developer unit is turned off after a voltage is supplied to the main charger to charge the surface of the photoconductor at a potential that does not cause carrier attraction, which is preceded by the supply of a voltage to the transfer charger to reversely charge the surface of the photoconductor to reduce the surface potential thereof to a low level after a voltage is supplied to the main charger to set the potential of the photoconductor at a prescribed high level; and an exposure unit control means for controlling the operation of the exposure unit on the basis of the operation timing of the exposure unit detected by the detection means so that the surface potential of the photoconductor is reduced nearly to the ground potential by the light projected from the exposure unit after the developing bias is turned off.

2. An electrophotographic apparatus according to claim 1, wherein said detection means is composed of a timer and an exposure unit.

3. An electrophotographic apparatus according to claim 2, wherein said voltage control means and said exposure unit control means are composed of a power control unit and a voltage output control circuit connected to said power control unit said voltage control circuit being connected to said power supply.

4. An electrophotographic apparatus according to claim 3, wherein said timer is connected to said power control unit to which said exposure unit is connected.

* * * * *